United States Patent [19]

Nolan

[11] Patent Number: 5,034,650

[45] Date of Patent: Jul. 23, 1991

[54] LAMP WITH COATING FOR ABSORPTION OF ULTRAVIOLET LIGHT

[76] Inventor: James D. Nolan, 16 Pickett Ave., Spencer, N.C. 28159

[21] Appl. No.: 518,488

[22] Filed: May 3, 1990

[51] Int. Cl.[5] ..... H01J 61/35; H01J 61/42

[52] U.S. Cl. ..... 313/112; 313/493; 313/635; 313/489

[58] Field of Search ..... 313/112, 493, 635, 489

[56] References Cited

U.S. PATENT DOCUMENTS

| | | | |
|---|---|---|---|
| 2,820,918 | 1/1958 | Aronstein | 313/112 X |
| 3,124,307 | 3/1964 | Hoskins et al. | 313/112 X |
| 3,426,234 | 2/1969 | Hayasaka et al. | 313/493 X |
| 3,602,759 | 8/1971 | Evans | 313/112 |
| 4,147,947 | 4/1979 | Hoeh | 313/493 X |
| 4,507,332 | 3/1985 | Nolan et al. | 427/67 |
| 4,804,886 | 2/1989 | Nolan et al. | 313/635 X |

*Primary Examiner*—Palmer C. DeMeo

*Attorney, Agent, or Firm*—R. Gale Rhodes, Jr.

[57] ABSTRACT

A lamp for providing illumination to ultraviolet light-sensitive materials and including a coating for providing the lamp envelope with a safety coating for containing debris produced upon the lamp envelope being broken and for substantially absorbing the ultraviolet light.

3 Claims, 1 Drawing Sheet

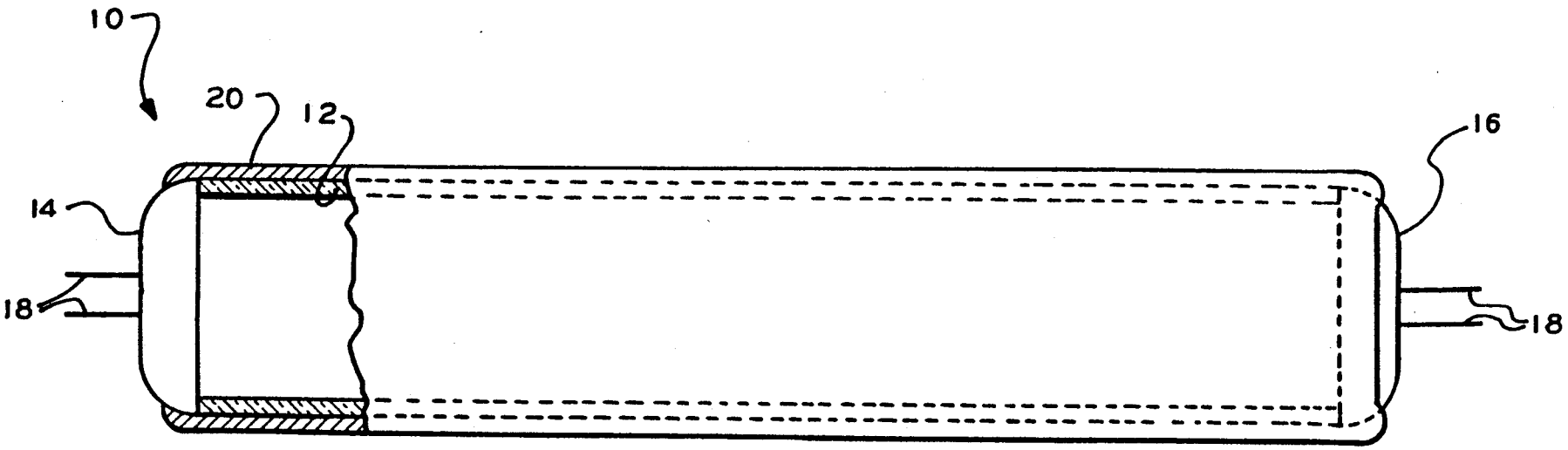
10
20
12
14
18
16
18

LAMP WITH COATING FOR ABSORPTION OF ULTRAVIOLET LIGHT

BACKGROUND OF THE INVENTION

The present invention relates to a new lamp for providing illumination to ultraviolet light-sensitive materials, such as for example photographic materials and the like, which lamp is of the type sometimes referred to as a safelight.

SUMMARY OF THE INVENTION

The new lamp provides illumination including ultraviolet light and includes a safety coating provided on the lamp envelope for containing debris, such as broken glass or glass shards, produced upon the glass envelope of the lamp being broken, and which safety coating substantially absorbs the ultraviolet light produced by the lamp. Such containment of the glass shards prevents, or substantially reduces, the hazard presented to nearby people, exposed food, etc., upon the glass envelope of the lamp being broken.

DESCRIPTION OF THE DRAWING

The drawing is a diagrammatical illustration of a lamp, e.g. a fluorescent lamp, for providing illumination to ultraviolet sensitive material; the left portion of the drawing is broken away to show structure in cross-section.

DESCRIPTION OF THE PREFERRED EMBODIMENT

The lamp 10 shown in the drawing for providing illumination including ultraviolet light may be a suitable fluorescent lamp such as those of the cool white and daylight type fluorescent lamps, presently commercially available from numerous sources. Such fluorescent lamps, as known, include a glass envelope 12 provided at opposite ends with end caps 14 and 16 from which protrude electrically connecting pins 18—18.

The safety coating 20 shown in the drawing may include, by percentages of weight set forth below, plastic coating material, ultraviolet absorption material and at least one antioxidant material.

The plastic coating material may be ethylene-methacrylic acid copolymer, partial metal salt; and more particularly may be copolymer of ethylene with ethylenetically unsaturated carbocylic acid at least partially neutralized with a metal ion. Such plastic coating material is currently commercially available from E. I. Du Pont De Nemours & Company (Inc.) under the designation SURLYN 8660 [SURLYN is the registered trademark of Du Pont]. Preferably, the plastic coating material is about 97% to about 98% by weight of the safety coating.

The ultraviolet absorption material may be 2,2'-Dihydroxy-4-methoxybenzophenone. Such ultraviolet absorption material is currently commercially available from the American Cyanamid Company under the designatin CYASORB UV24 [CYASORB is the registered trademark of the American Cyanamid Company]. Preferably, the ultraviolet absorption material is about 2.0% by weight of the safety coating.

Preferably, the antioxidant is comprised of at least two antioxidants each of which is about 0.1% by weight of the safety coating. One of the antioxidants may be a primary hindered phenolic stabilizer, and more particularly may be 1,3,5-Tris (4-tert-butyl-3-hydroxy-2,6-dimethylbenzyl)-1,3,5-triazine-2,4,6-(1H,3H,5H)-trione. Such antioxidant is presently commercially available from the American Cyanamid Company under the name CYANOX 1790 [CYANOX is the registered trademark of the American Cyanamid Company]. The second antioxidant may be distearyl pentaerythritol diphosphite containing approximately 1% by weight of triisopropanol amine. Such antioxidant is currently commercially available from G. E. Plastics, General Electric Company, under the name WESTON 619 [WESTON is the registered trademark of Borg-Warner Chemicals Inc.].

The plastic coating material, ultraviolet absorption material, and antioxidant material or materials may be suitably mixed in the noted percentages by weight manually or may be mixed by suitable commercially available mixing machines. Such safety coating material may be employed in a suitable fluidized bed such as disclosed in U.S. Pat. No. 4,507,332 entitled METHODS FOR COATING THE GLASS ENVELOPE AND PREDETERMINED PORTIONS OF THE END CAPS OF A FLUORESCENT LAMP, patented Mar. 26, 1985, of which I am a co-inventor, and the safety coating material may be applied to the fluorescent lamp using the coating methods disclosed in this patent. U.S. Pat. No. 4,507,332 is hereby incorporated herein by reference.

It will be understood that the above is a description of a preferred embodiment of a new lamp for providing illumination to ultraviolet light-sensitive materials, and it will be further understood that many variations and modifications may be made in the new lamp without departing from the invention.

What is claimed is:

1. A lamp for providing illumination to ultraviolet light-sensitive materials, comprising:

lamp means for providing illumination including ultraviolet light;

coating means providing said lamp means with a safety coating for containing debris produced upon said lamp being broken and for substantially absorbing said ultraviolet light; and said coating means including about 97% to 98% by weight of plastic coating material, about 2.0% by weight of ultraviolet absorption material and about 0.2% by weight of at least one antioxidant material.

2. The lamp according to claim 1 wherein said lamp means is a fluorescent lamp including a glass envelope and end caps and wherein said coating means surround said glass envelope and sufficient portions of said end caps whereby upon said glass envelope being broken into glass shards said coating means maintain said glass shards and said end caps in association within said coating means to prevent broadcasting of said glass shards.

3. The lamp according to claim 1 wherein said plastic coating material is ethylene-methacrylic acid copolymer, partial metal salt; wherein said ultraviolet absorption material is 2,2'-Dihydroxy-4-methoxybenzophenone and wherein said at least one antioxidant material comprises at least first and second antioxidant materials and wherein said first antioxident material is a hindered phenolic stabilizer and wherein said second antioxident material is distearyl pentaerythritol diphosphite containing approximately 1% by weight of triisopropanol amine.

* * * * *